US006626376B1

(12) United States Patent
Rose

(10) Patent No.: US 6,626,376 B1
(45) Date of Patent: Sep. 30, 2003

(54) SPRAY COATING DEVICE

(75) Inventor: James L. Rose, Brookshire, TX (US)

(73) Assignee: Airtech Spray Systems, Inc., Houston, TX (US)

( * ) Notice: Subject to any disclaimer, the term of this patent is extended or adjusted under 35 U.S.C. 154(b) by 121 days.

(21) Appl. No.: 09/881,183

(22) Filed: Jun. 14, 2001

(51) Int. Cl.[7] ..... B05B 3/00

(52) U.S. Cl. ..... 239/264; 239/237; 239/248; 118/316; 118/DIG. 11

(58) Field of Search ..... 239/264, 232, 239/237, 239, 242, 245, 248; 118/DIG. 11, 316, 323, 319–324

(56) References Cited

U.S. PATENT DOCUMENTS 2,535,451 A 12/1950 Phillips
4,205,694 A * 6/1980 Thompson et al. .. 118/DIG. 11
4,595,607 A 6/1986 Betteridge et al.
4,953,496 A 9/1990 Taylor et al.
5,069,234 A * 12/1991 Nielsen ..... 118/DIG. 11
5,129,355 A 7/1992 Taylor et al.
5,207,833 A 5/1993 Hart
5,417,786 A 5/1995 Denman et al.
5,520,734 A 5/1996 Taylor et al.
5,743,969 A * 4/1998 Lawler ..... 118/307

* cited by examiner

*Primary Examiner*—Michael Mar
*Assistant Examiner*—Dinh Q. Nguyen
(74) *Attorney, Agent, or Firm*—Loren G. Helmreich; Browning Bushman P.C.

(57) ABSTRACT

A spray coating device (14) for coating a pipeline (12) comprises an upper frame (42) having a pair of arms (62, 64) pivotally mounted on opposed sides of the pipeline. Each arm (62, 64) has radially spaced inner and outer guides (86, 88) and a flexible endless drive member (94) is mounted on each arm and extends between the ends of the arm for over 180 degrees. A spray nozzle carriage (124) with a spray nozzle (142) is mounted on each arm (62, 64) for movement along the inner and outer guides (86, 88) of the associated arm between the ends of the arm.

23 Claims, 9 Drawing Sheets

FIG. 5
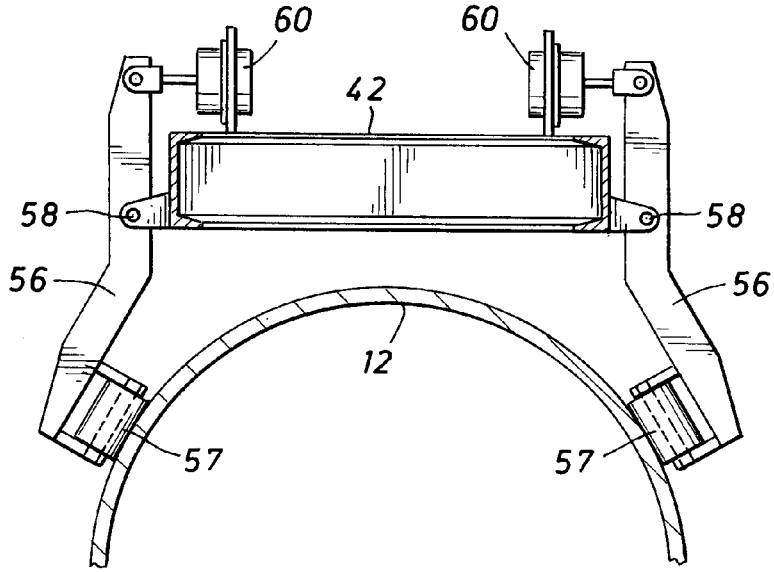
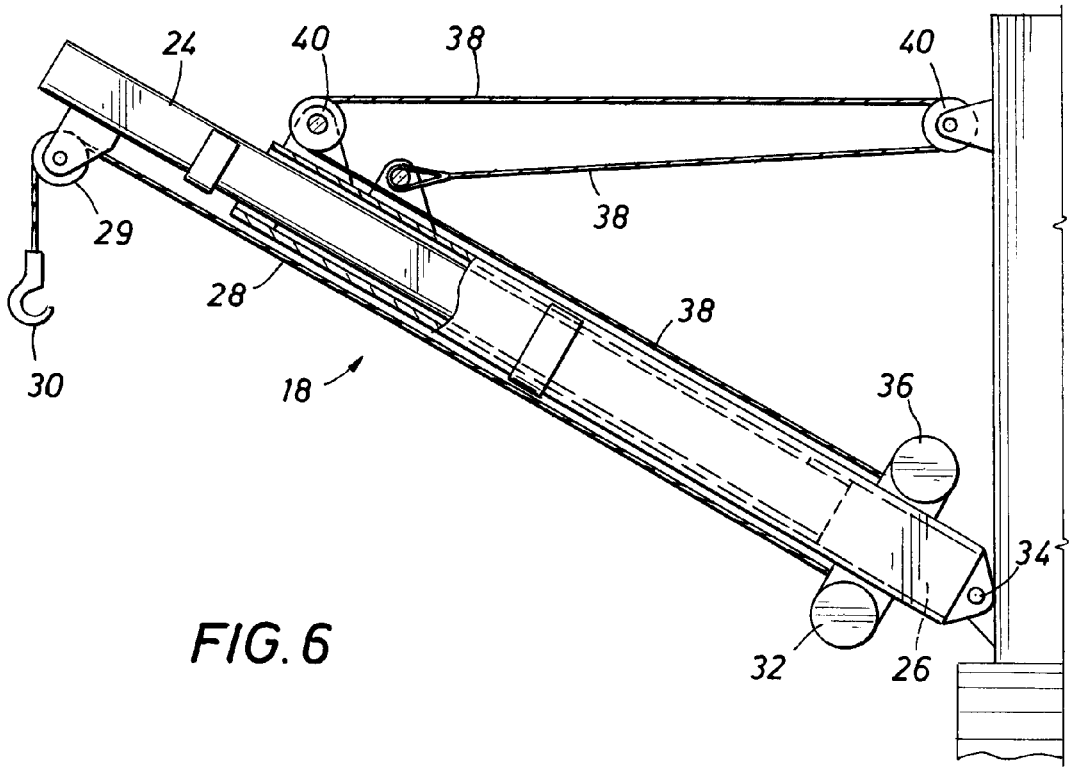
FIG. 6

SPRAY COATING DEVICE

FIELD OF THE INVENTION

This invention relates to a spray coating device for coating a pipeline, and more particularly to a spray coating device for coating a pipeline as the spray coating device travels longitudinally along the pipeline.

BACKGROUND OF THE INVENTION

Pipelines when buried in the ground normally have an outer protective coating from corrosion and other detrimental effects. Over a period of time, a coating degrades and it may be necessary or desirable to remove the old coating and apply a new protective coat to the pipeline. For replacement of the old coating, the pipeline is removed from the ground and the old coating removed. The surface of the pipeline is then cleaned for application of the new coating of protective material. Normally a crane is utilized to lift the pipeline out of the trench with the exposed pipeline supported on skids or the like to permit access to the entire outer surface of the pipeline. After coating of the pipeline, the pipeline is lowered within the trench and covered with a suitable material.

Various types of spray coating nozzles have been utilized heretofore and some have been mounted on spray coating devices which are supported on the pipeline and move longitudinally along the pipeline. Normally, a pair of arms or arcuate rings of a semicircular shape encircle the pipeline and spray nozzles are mounted on the arms for coating the pipeline. In some instances, a plurality of nozzles are secured to the arms and pivot back and forth along a desired arc for coating of the pipeline. In other instances, the nozzles are mounted on carriages which move back and forth in an arcuate direction along the arms for spraying the coating onto the exterior surface of the pipeline during such movement or travel. The carriages reverse direction at the ends of the arcuate arms.

For example, as shown in U.S. Pat. No. 5,207,833 dated May 4, 1993, a spray coating device has been provided for coating a pipeline with the device supported on the pipeline and traveling longitudinally along the pipeline. A yoke is mounted about the pipeline for encircling the pipeline and carriages having a spray gun or nozzle thereon are mounted for movement along the yoke. The yoke is formed of a pair of generally semicircular halves or yoke portions and a carriage is mounted on each of the semicircular yoke portions. Each carriage has a single spray nozzle or gun thereon and the nozzle is mounted for pivotal movement relative to the carriage. The carriages are driven by endless belts which are reversed at the ends of the arms for reciprocation of the carriages. Such an arrangement requires controls for reversing the direction of travel of the drive belts and also results in additional time for reversing of the drive belts.

U.S. Pat. No. 4,953,496 shows an apparatus for both cleaning and coating the exterior surface of a pipeline. A pair of arcuate rings are mounted on separate arms which are mounted for pivotal movement between an operating position on a pipeline and a position for the removal of the apparatus from the pipeline. Carriages which mount spray nozzles thereon travel back and forth along the rings on the arms. The arms in addition to supporting the rings also have rollers thereon which ride along the outer surface of the pipeline for centering of the spray apparatus on the pipeline. Various hoses or lines extend to the apparatus for supplying the spray materials and hydraulic fluid. A suitable crane is normally used for lifting the spray device onto the pipeline and removing the device from the pipeline.

It is desirable that a spray coating device be provided in which carriages are mounted for reciprocal movement along a pair of arcuate arms and driven by flexible endless members that operate continuously in a single direction without being reversed.

SUMMARY OF THE INVENTION

The present invention includes a self-propelled spray coating device for coating a pipeline which is supported on the pipeline and travels longitudinally along the pipeline. A pair of generally semicircular arms are mounted on opposed sides of the pipeline for encircling the pipeline with each arm having radially spaced inner and outer guides. A nozzle carriage is mounted on each arm for arcuate reciprocal movement over 180 degrees along the inner and outer guides. An endless drive member is mounted on each arm and extends along the length of the arcuate arm. A drive connection is provided between each carriage and the associated flexible endless drive member to connect the drive member in driving relation to the carriage. The drive connection is effective at the ends of the arm to transfer the driving force for the carriage between inner and outer runs of the endless drive member thereby to permit a continuous movement of the endless drive member in one direction for the entire travel cycle of the carriage. The flexible endless drive member preferably comprises a chain mounted on sprockets at the ends of the arm for continuous movement of the chain in one direction. Each carriage has rollers for traveling along the radially spaced inner and outer guides on the associated arm.

To center the spray coating device, a pair of opposed separate arms are pivotally mounted on the frame of the device and are pivoted between engaged and disengaged positions with the outer surface of the pipeline. Rollers on the arms contact the outer surface of the pipeline for centering of the spray coating device.

The spray coating apparatus includes a self-propelled support vehicle movable alongside the pipeline and carrying various elements and controls for supporting the spray coating operation and the hydraulic fluid operation. A telescoping boom is pivotally connected to the support vehicle and is utilized for lifting the spray coating device on and off the pipeline in addition to supporting lines for hydraulic fluid and for the spray coating material. An operator for the spray coating operation controls the operation from a control panel on the vehicle. A support frame on the ground is provided to support the spray coating device when removed from the pipeline.

Various coating materials may be utilized such as an epoxy resin material in two components which harden when blended and cured. When cured, a hard polymer or epoxy resin material is formed to provide a strong, hard, outer liner for the coating on the pipeline. A two component polyurethane coating may also be utilized.

The thickness of the coating may be determined primarily by the speed of the spray coating device along the pipeline, the speed of the carriages moving back and forth along the arms, and the amount of coating material discharged from the nozzles. A central control panel on the self-propelled vehicle traveling alongside the pipeline permits an operator to control the entire coating process. Two or three layers of the coating material are normally applied to the pipeline and may be obtained by a selected overlap of the layers.

It is an object of the invention to provide a spray coating apparatus for spray coating a pipeline and supported on the pipeline for longitudinal travel along the pipeline.

It is a further object of the invention to provide such a spray coating device in which spray gun carriages are mounted on opposite sides of the pipeline for travel along generally semicircular arms which encircle the pipeline.

It is a further object of the invention to provide a spray coating device in which the spray nozzle carriages are driven by endless drive members connected to the carriages so that the carriages are reciprocated in a continuous movement of the endless drive members in a single direction for the entire travel cycle of the carriages.

A further object is to provide a lightweight spray coating device including a pair of arcuate arms suspended from a support frame and having a pair of spray nozzle carriages on the arms which move back and forth along the arms for spraying a coating on the exterior surface of the pipeline in a minimum of time thereby to provide a minimum of operating parts at a substantially lighter weight than heretofore.

Another object of the invention is the provision of a support vehicle for the spray coating device which travels alongside the pipeline during the entire operation and has a telescoping boom for supporting hoses for the coating material and hydraulic fluid in addition to lifting the spray coating device on and off the pipeline.

Other objects, features, and advantages of the invention will be apparent from the following specification and drawings.

BRIEF DESCRIPTION OF THE DRAWINGS

FIG. 5 is a sectional view taken along line 5—5 of FIG. 2 and showing a pair of arms having rollers for centering of the spray coating device on the pipeline;

FIG. 6 is an elevational view of the telescoping boom mounted on the support vehicle which travels alongside the pipeline;

DESCRIPTION OF THE INVENTION

Figure 1:
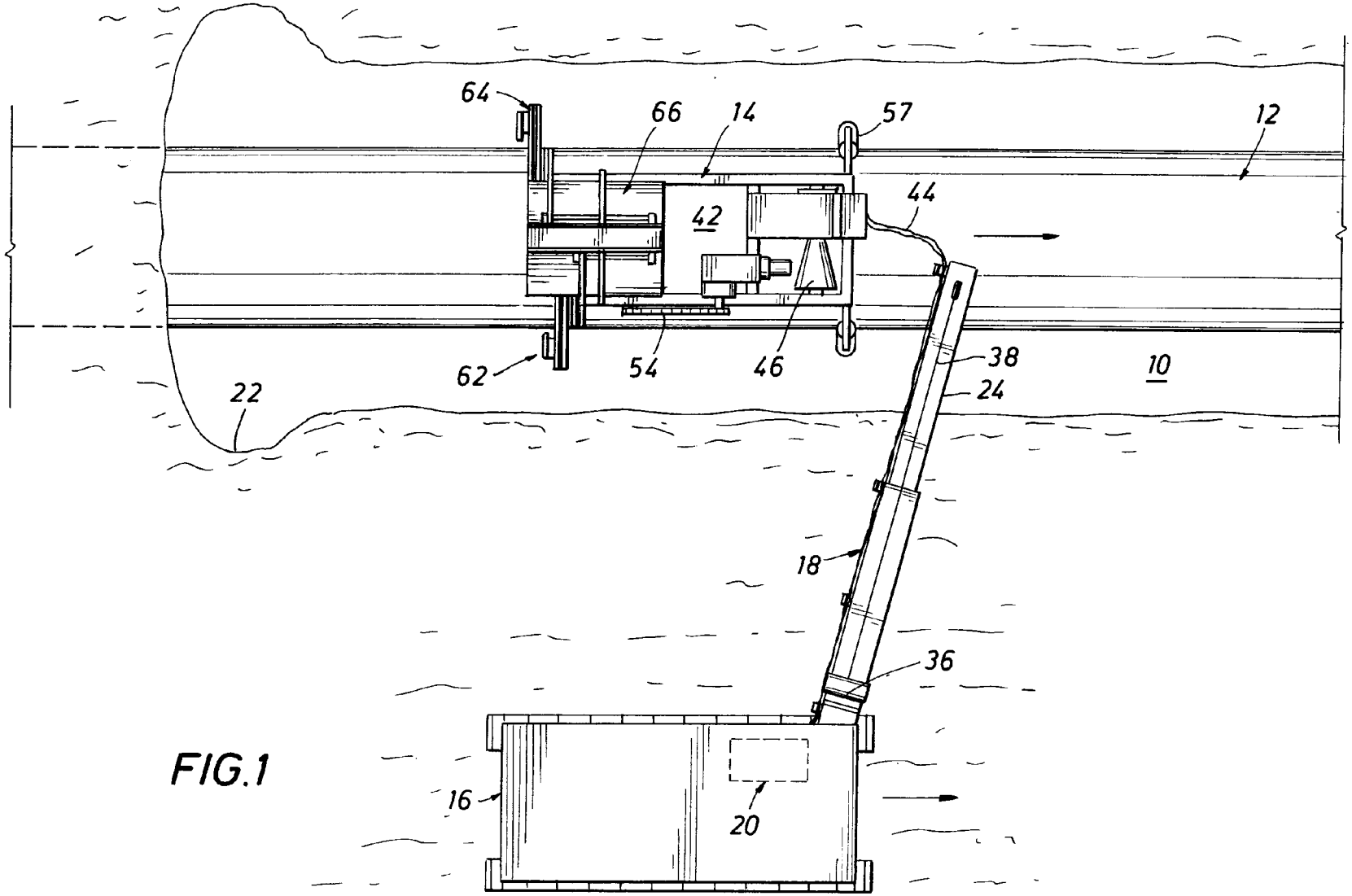
FIG. 1 is a top plan view of the spray coating apparatus comprising the present invention including a spray coating device mounted on a pipeline for travel along the pipeline and a self-propelled vehicle mounted for movement alongside the pipeline having a telescoping boom for lifting the spray coating device onto and off the pipeline.
Figure 3:
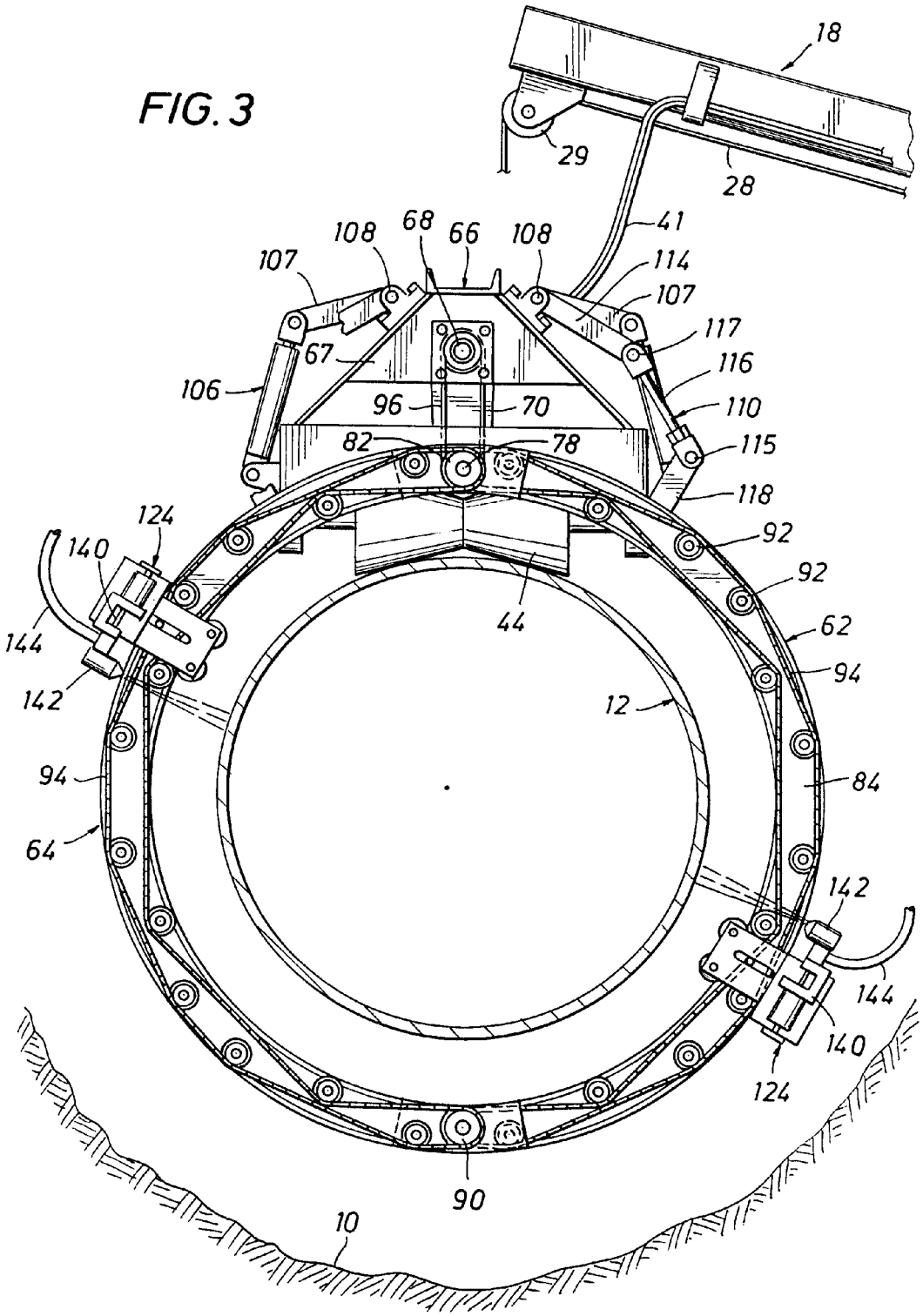
FIG. 3 is an end elevation of the spray coating device shown in FIGS. 2 and 3 with the arms shown in a closed position about the pipeline.

Referring now particularly to the drawings and more particularly to FIGS. 1 and 3, a trench 10 is shown in the ground surface and a pipeline generally indicated at 12 is shown in the trench and lifted to a position above the bottom of the trench such as shown in FIG. 3. Pipeline 12 normally has a section about 80 to 100 feet in length which is uncovered and lifted from trench 10 for cleaning and application of a new coating thereon. After application of the coating, the pipeline section is lowered into the trench and covered by suitable soil with another section being uncovered and raised.

The spray coating apparatus includes a spray coating device generally indicated at 14 supported on the upper surface of pipeline 12 for movement therealong. A self-propelled support vehicle is shown at 16 for movement alongside the pipeline 12 with the self-propelled spray coating device 14. A telescoping boom 18 is mounted on vehicle 16 and is effective for lifting of spray coating device 14 and for supporting the various lines to spray coating device 14 such as lines for the spray coating material and for hydraulic fluid that may be supplied from self-propelled support vehicle 16. The spray coating material may comprise two separate components which are mixed on vehicle 16. Hydraulic fluid components such as pumps and reservoirs are also mounted on vehicle 16. An operator for self-propelled support vehicle 16 has a control panel 20 for controlling the operation of the spray coating apparatus. Trench 10 may be enlarged as shown at 22 for the installation of spray coating device 14 onto pipeline 12.

As shown in FIG. 6, boom 18 has an inner telescoping section 24 extended and withdrawn by hydraulic cylinder 26. Cable 28 about pulley 29 has a hook 30 thereon and is controlled by a hydraulically or electrically driven winch 32. Boom 18 is pivotally mounted at 34 to vehicle 16 and a hydraulically or electrically driven winch 36 has a cable 38 extending therefrom about pulleys 40 for controlling the position of boom 18. As shown in FIG. 3, various lines 41 are supported by boom 18.

Self-propelled spray coating device 14 has a generally rectangular main support frame 42 thereon with upper rollers 44 and 46 mounted thereon for riding along the upper surface of pipeline 12. Rollers 44, 46 are mounted on axles 47. Axle 47 for rear roller 44 has a sprocket 49 thereon. A hydraulic motor shown at 48 is connected to a gear reducer 50 for driving sprocket 52. Sprocket chain 54 extends about sprockets 49, 52 for rotating rear axle 47 and rear roller 44 to propel the spray coating device 14 along pipeline 12. The speed of spray coating device 14 along pipeline 12 may be controlled by hydraulic motor 48 by an operator of control panel 20 on adjacent support vehicle 16.

To center spray coating device 14 on pipeline 12 and referring to FIG. 5, arms 56 are pivotally mounted at 58 to support frame 42. Hydraulic or air cylinders 60 are effective to pivot arms 56 and rollers 57 thereon for engagement of rollers 57 with the outer surface of pipeline 12 for centering of spray coating device 14 onto pipeline 12 for traveling along pipeline 12.

Referring now particularly to FIGS. 2–4 and 10, a pair of arcuate arms generally indicated at 62 and 64 are shown.

Each arm 62, 64 extends in an arc of about 190 degrees for an overlap of arms 62 and 64. Arms 62 and 64 are staggered as shown particularly in FIG. 2. A hood 66 is mounted on frame 42 and a drive shaft 68 is supported from the ends 67 of hood 66 and from support plates 70 secured to and extending downwardly from hood 66. For mounting of arm 62 from shaft 68, reference is made particularly to FIG. 10. Bearing 74 for shaft 68 is mounted on support plate 70. A lower bearing 76 is mounted on support plate 70 and a pivot support countershaft or rod 78 having opposed sprockets 80 and 82 secured thereto is mounted within lower bearing 76. Arm 62 has an arcuate plate or body 84 with radially spaced outer and inner guides 86 and 88 mounted about the rims of plate 84. Arm 62 includes a lower end sprocket 90 and idler rollers 92 on plate 84. A sprocket chain 94 extends about end sprockets 82, 90 and rollers 92 as shown particularly in FIGS. 3 and 4.

Figure 10:
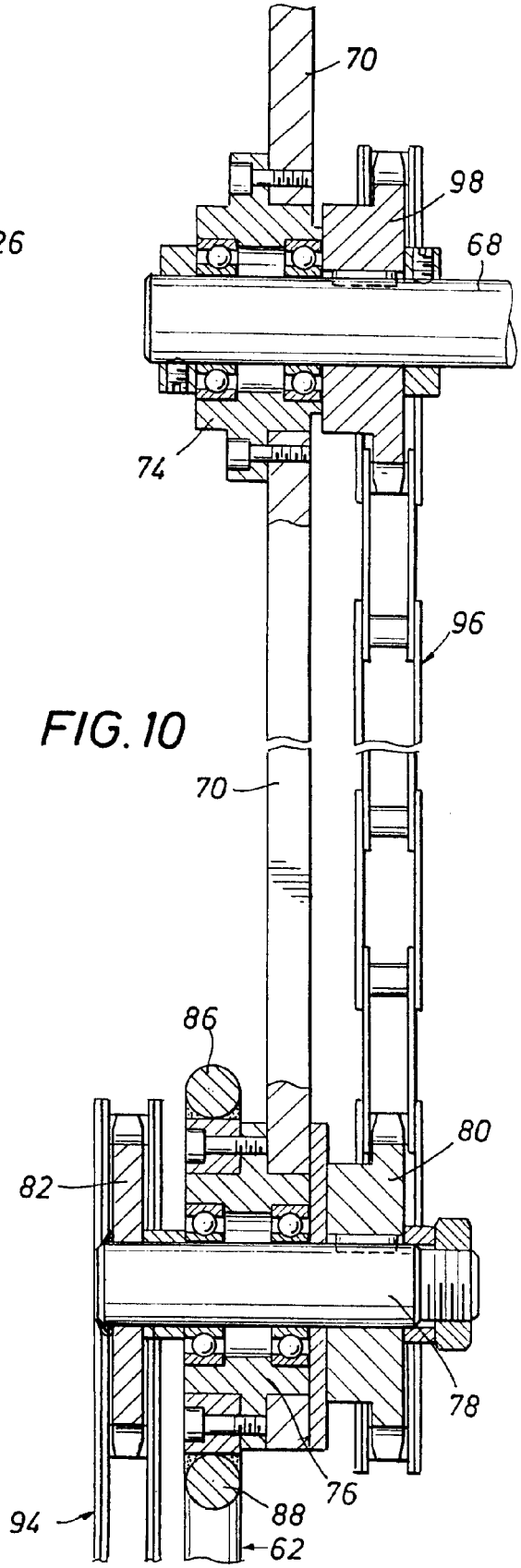
FIG. 10 is an enlarged sectional view of the drive mechanism shown in FIG. 2 for driving an endless chain for the nozzle carriages.

As shown particularly in FIG. 10, a drive sprocket chain 96 is mounted about sprocket 98 secured to drive shaft 68 and about sprocket 80 secured to countershaft 78. A hydraulic motor 100 has a shaft 102 extending therefrom and connected to drive shaft 68 through universal joint 104. Hydraulic motor 100 drives shaft 68 which is effective to rotate sprockets 80, 82 from drive sprocket 98 thereby to drive endless chain 94 in a continuous direction along arm 62. Arm 64 is generally similar to arm 62 and like numerals on arm 64 indicate elements similar to the elements of arm 62.

Figure 4:
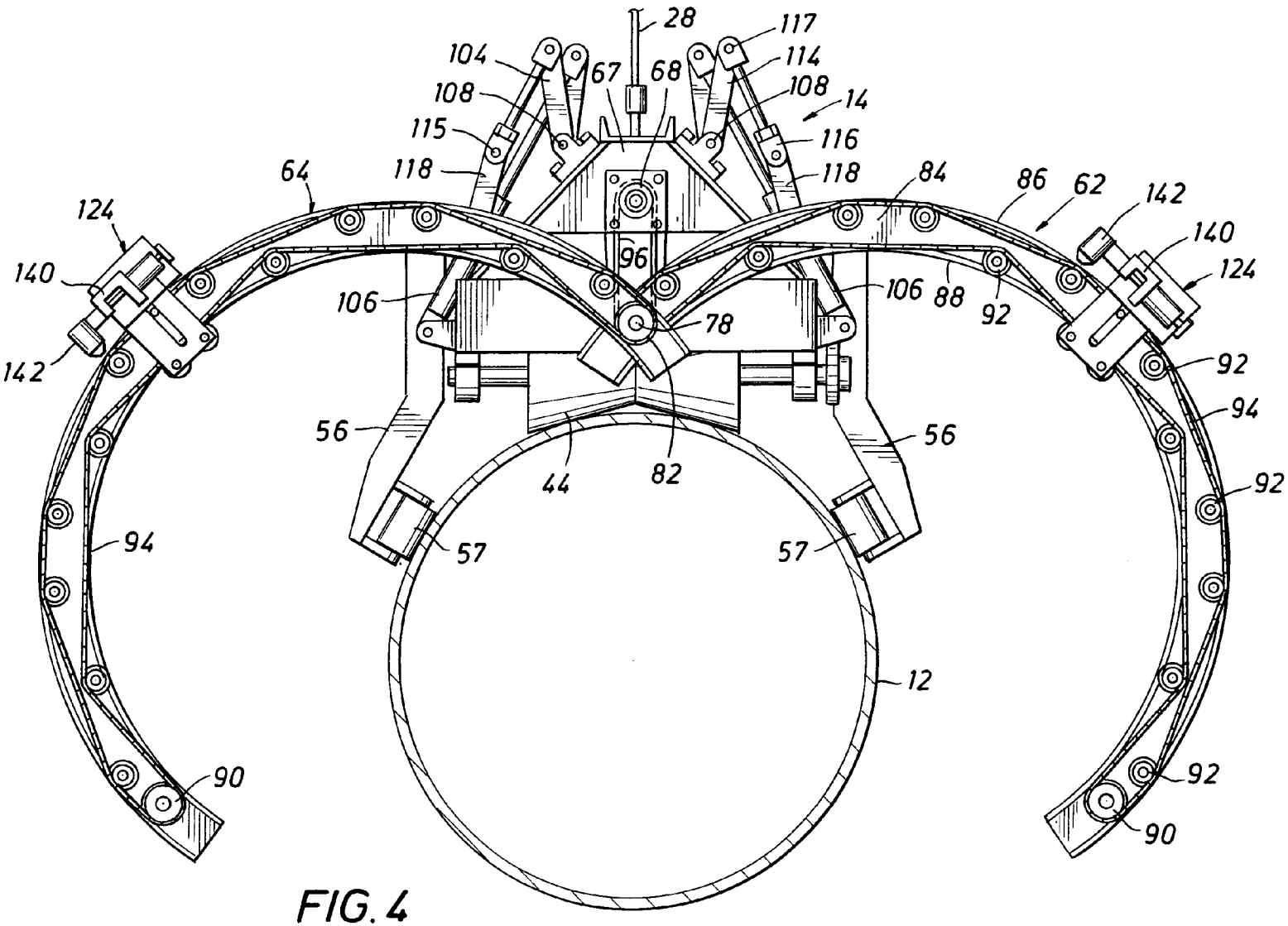
FIG. 4 is a side elevation similar to FIG. 3 but showing the arms moved to an open position for installation of the device on the pipeline and for removal of the device from the pipeline.
Figure 7:
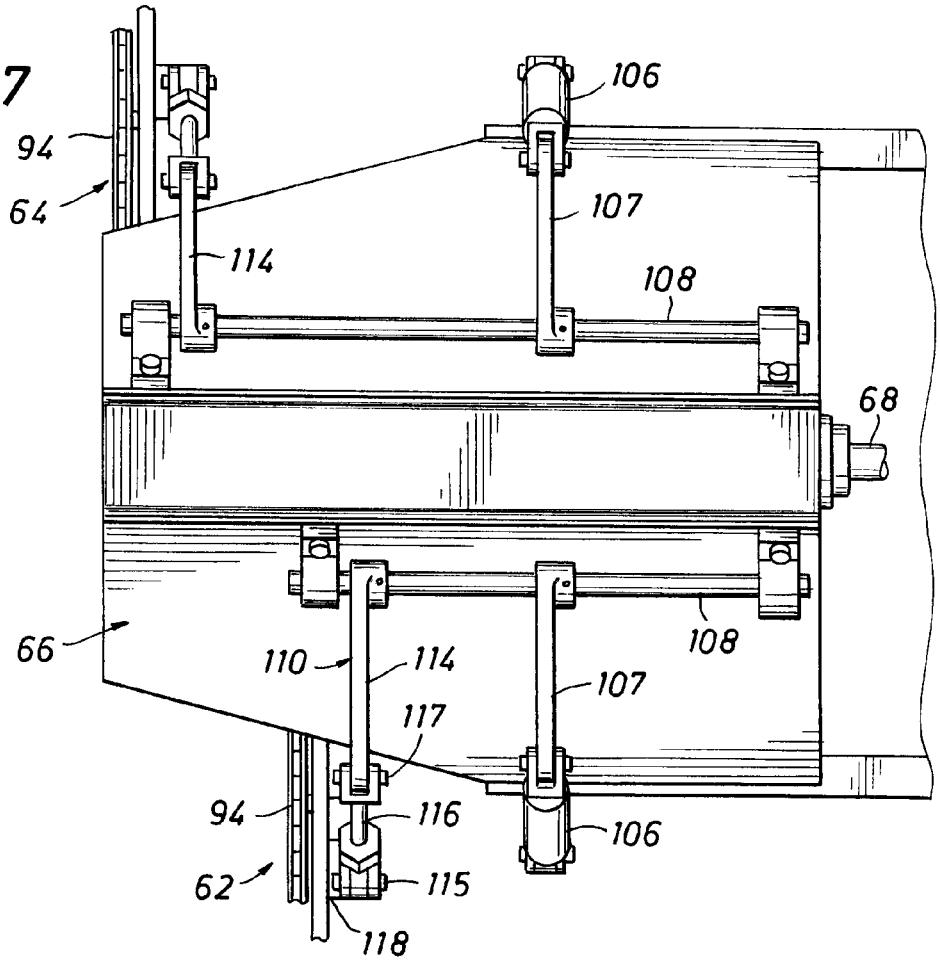
FIG. 7 is a top plan of the mechanism for swinging the arms between engaged and disengaged positions.
Figure 8:
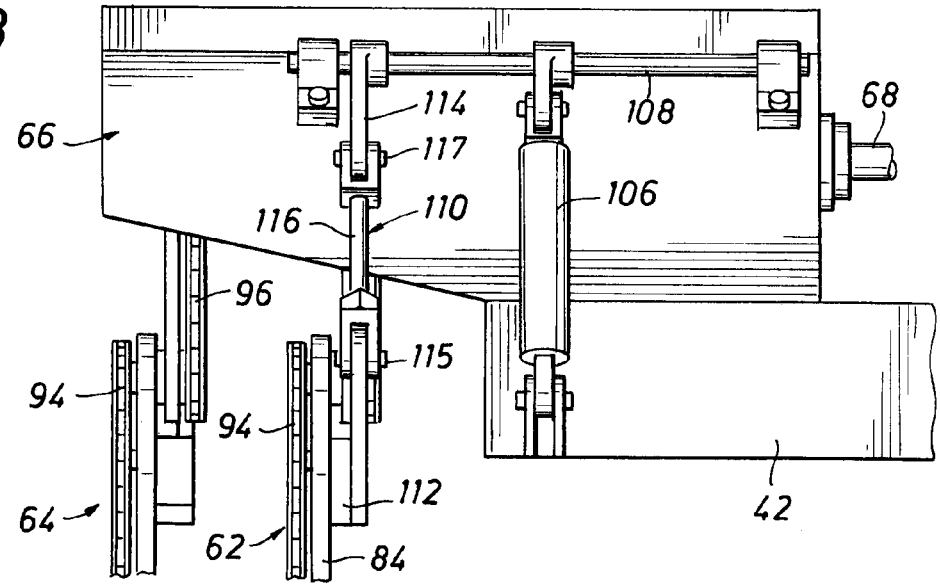
FIG. 8 is a side elevational view of the mechanism shown in FIG. 7.

For swinging or pivoting arms 62 and 64 about the axis of countershaft 78 between an installed closed position as shown in FIG. 3 from an open position as shown in FIG. 4 which is a position for installation or removal of spray coating device 14, hydraulic cylinders 106 connected to links 107 as shown particularly in FIGS. 7 and 8 are provided for rotation of shaft 108. A linkage generally indicated at 110 is connected between shaft 108 and a bracket 112 secured to arcuate plate 84. Linkage 110 includes a link 114 secured to shaft 108 and a connecting link 116 pivotally connected at 115 to bracket 112 and at 117 to link 114. Thus, actuation of cylinder 106 is effective for rotation of arm 62 about the axis of countershaft 78. Arm 64 is pivoted in a similar manner.

Figure 2:
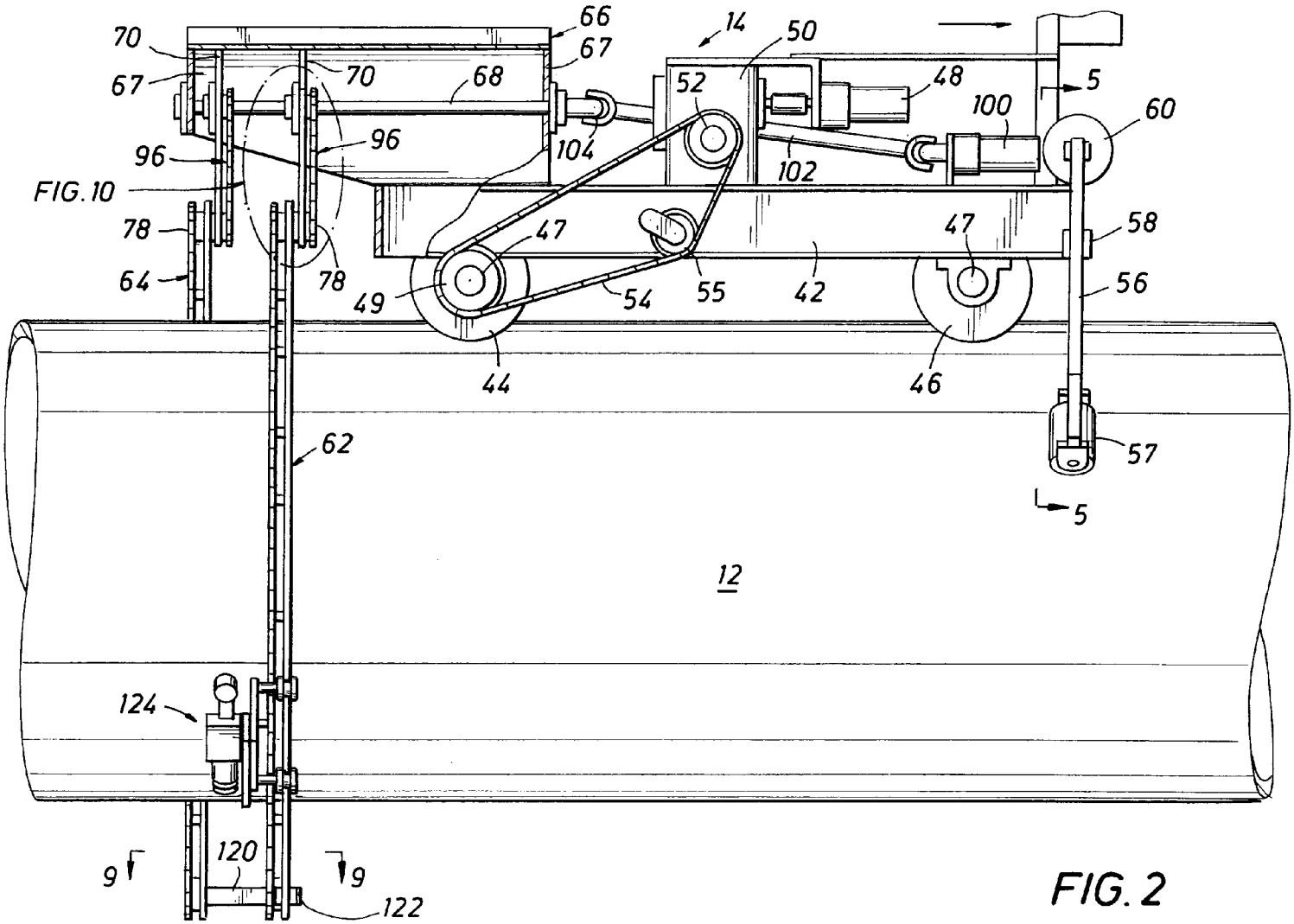
FIG. 2 is a side elevation of the spray coating device shown in FIG. 1 supported on the pipeline for movement along the pipeline in an operating position.
Figure 9:
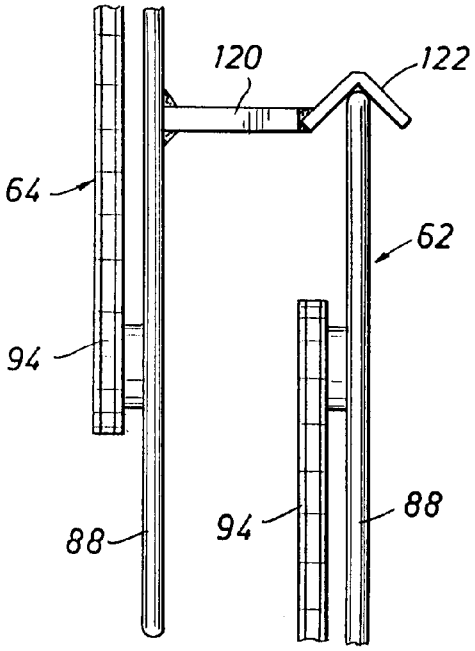
FIG. 9 is a sectional view taken generally along line 9—9 of FIG. 2.

Upon movement of arms 62 and 64 from the open position in FIG. 4 to the closed position of FIG. 3, the lower arcuate ends of arms 62 and 64 engage each other as shown in FIGS. 2 and 9 to maintain the spacing between arms 62, 64 during operation of spray coating device 14. A connecting bar 120 is secured to arm 64 and has a V-shaped stop 122 mounted on the end of bar 120 to receive arm 62 thereby to position arms 62 and 64 in spaced relation to each other during the operation of spray coating device 14.

Figure 13:
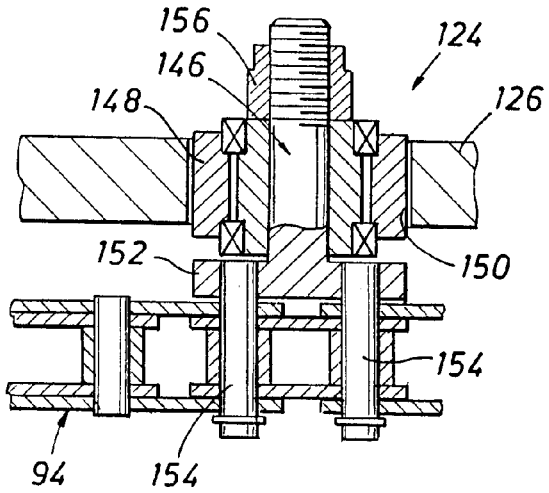
FIG. 13 is a sectional view taken generally along line 13—13 of FIG. 12.
Figure 11:
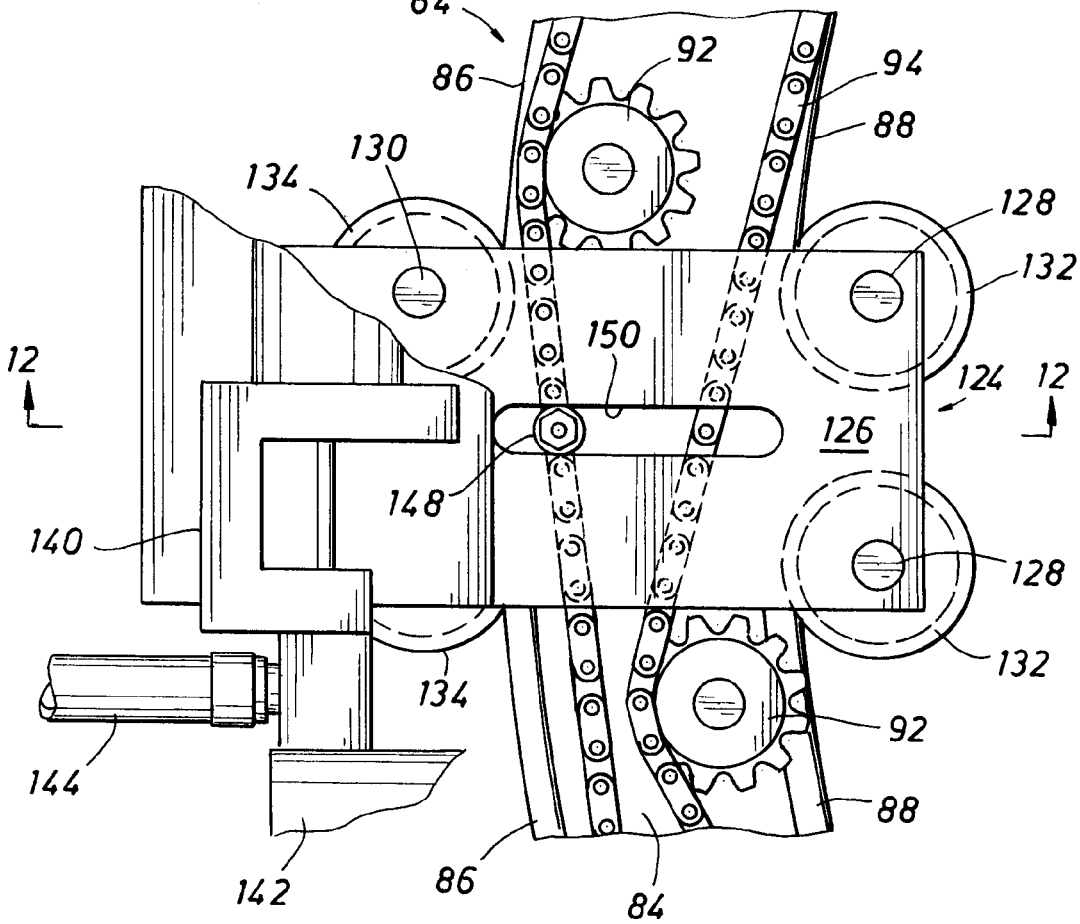
FIG. 11 is a side elevation of a nozzle carriage mounted on an arcuate arm for travel along the arm and including a spray nozzle thereon.
Figure 12:
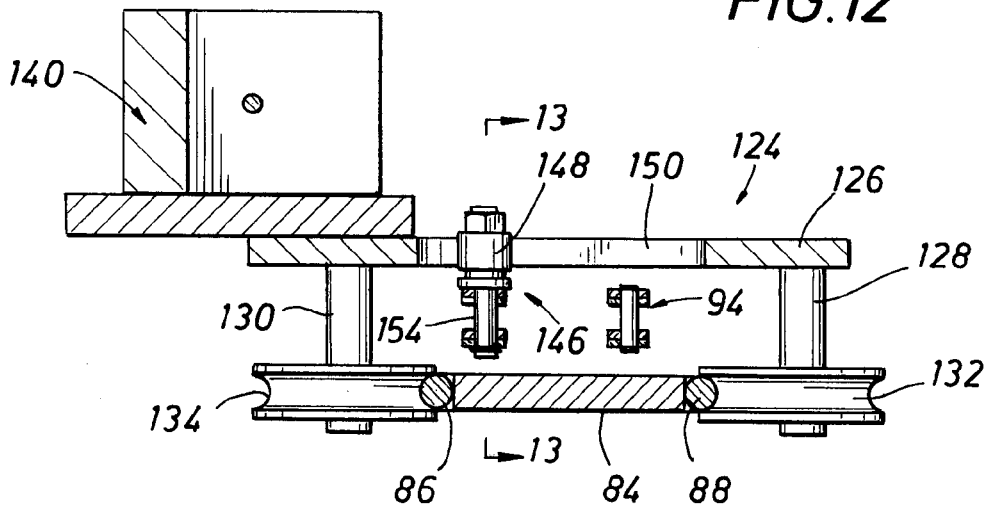
FIG. 12 is a sectional view taken generally along line 12—12 of FIG. 11.

As shown particularly in FIGS. 11 and 12, a nozzle carriage is generally indicated at 124 having a base plate 126 with inner and outer axles 128, 130 secured thereto and having inner and outer rollers 132, 134 mounted thereon for rotation. A nozzle mounting bracket generally indicated at 140 is secured to base plate 126 and mounts a spray nozzle 142 thereon having a line 144 for the supply of the spray material to nozzle 142. For movement of carriage 124 along arms 62 and 64, a drive pin indicated at 146 in FIGS. 12 and 13 has a bearing 148 with inner and outer races extending about drive pin 146 and is received within an elongated opening or slot 150 in base plate 126. Drive pin 146 has an end flange 152 mounting connecting pins 154 which are received within adjacent links of link chain 94 particularly as shown in FIG. 13. A nut 156 is mounted on externally threaded end of pin 146 for securing drive pin 146 onto drive chain 54. Carriage 124 is mounted for continuous movement with endless chain 94 during a complete cycle of drive chain 94. When drive chain 94 moves about the end sprockets 82 and 90, pin 146 moves along slot 150 between inner and outer runs of chain 94 thereby to permit carriage 124 to move back and forth or reciprocate along arcuate arm 64 without any reversing travel of drive chain 94 during the entire cycle of travel.

Figure 14:
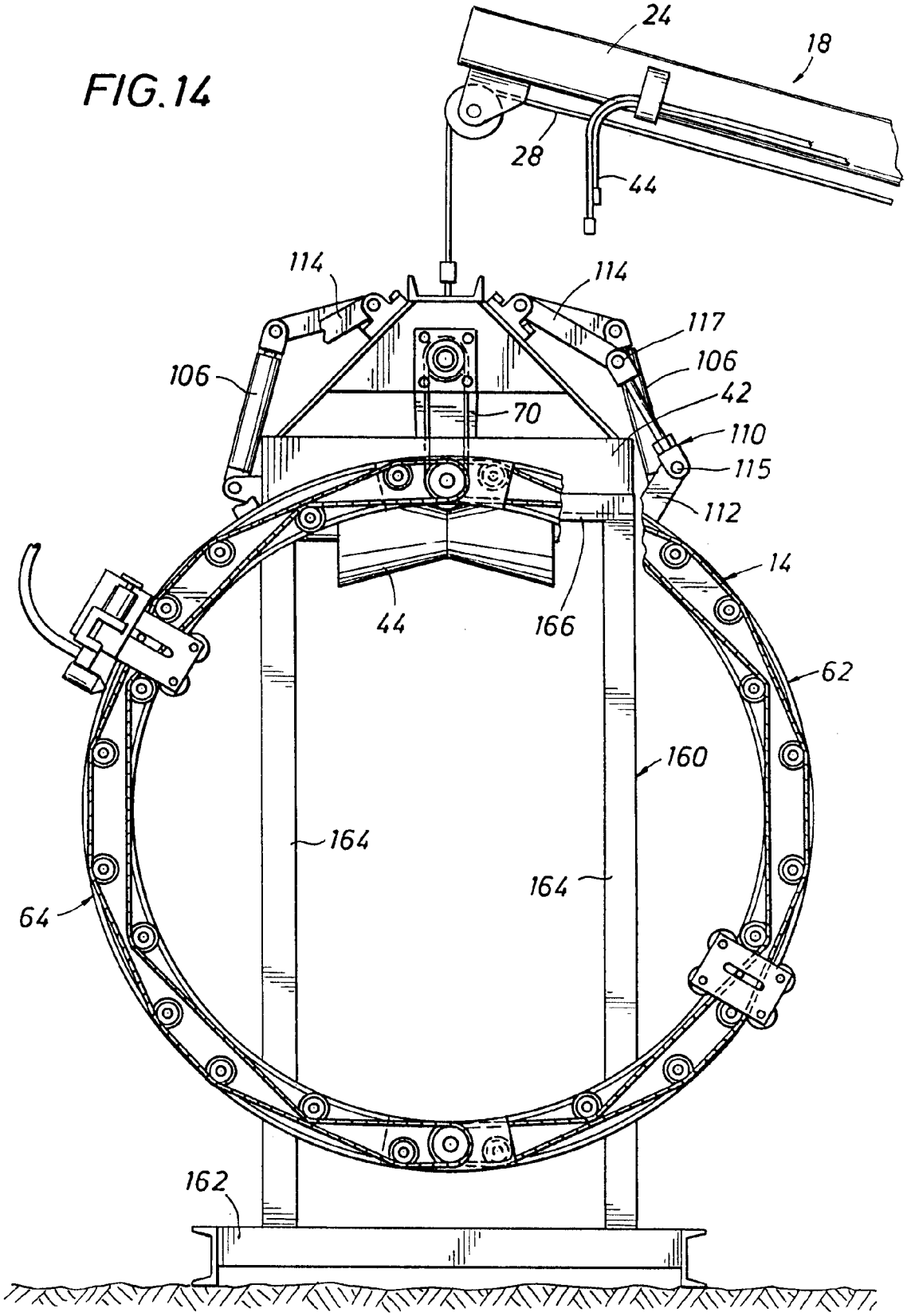
FIG. 14 is an end elevation view of the spray coating device of the present invention removed from the pipeline and supported on a stand adjacent the pipeline.

Referring to FIG. 14, a support stand is generally indicated at 160 to support spray coating device 14 thereon when removed from pipeline 12. Support stand 160 has a lower base 162 and four vertical legs 164 with an upper flat support table 166 supported by the upper ends of legs 164. Table 166 corresponds generally to the width of base 42 of spray coating device 14 but has a shorter length sufficient to fit between rollers 44 and 46 as shown in FIG. 14.

Operation of Spray Coating Device 14

Spray coating device 14 as shown in FIG. 14 is supported on stand 160 adjacent pipeline 12. Support vehicle 16 and boom 18 are positioned to lift spray coating device 14 from stand 160 by actuation of cable 28 having hook 30 engaging an eye on spray coating device 14 which is located generally at the center of gravity of spray coating device 14. Hydraulic cylinders 106 are actuated to pivot arms 62 and 64 about the axis of countershafts 78 to the open position as shown in FIG. 4. Spray coating device 14 is lowered by boom 18 onto pipeline 12 in the open position of arms 62 and 64 as shown in FIG. 4 with rollers 44, 46 engaging the upper surface of pipeline 12. Hydraulic cylinders 60 are then actuated to move arms 56 and rollers 57 thereon to an engaged position of rollers 57 with the outer surface of pipeline 12 for centering of spray coating device 14 on pipeline 12. Hydraulic cylinders 106 are then actuated to swing arms 62, 64 about the axis of countershafts 78 to a closed position about pipeline 12 as shown in FIG. 3 with V-shaped stop 122 on arm 64 engaged by arm 62 as shown in FIG. 9 for maintaining arms 62 and 64 in a predetermined spaced relation.

Next, hydraulic motor 48 is energized for rotation of drive shaft 68 and driving of sprocket chains 94 and 96 for arms 62 and 64 for movement of nozzle carriages 124 back and forth along arms 62 and 64. Hydraulic motor 48 is actuated for rotation of rear drive roller 44 for moving or propelling spray coating device 14 along the outer surface of pipeline 12.

Lines 41 for the hydraulic fluid and for the spray material and any other desired element are supported by boom 18 and connected to the various components on the support vehicle 16 moving along pipeline 12 with spray coating device 14. An operator at a control panel 20 on support vehicle 16 controls the entire operation.

Normally, the spray coating material comprises two components such as a polyurethane material having one part as a resin and the other part as an isocyanate. When the two parts are mixed, the material sets up in a hard state within a short time period. The two part spray material is mixed on support vehicle 16 and immediately travels through lines 41 to the spray nozzles 142 which have been positioned a predetermined distance from the outer surface of the pipeline 12. As arms 62 and 64 extend in an arcuate direction more than 180 degrees, the spray patterns of the nozzles overlap. After the coating has been applied, solvent is driven through the nozzles and lines to prevent the spray material from setting up within the lines or apparatus. Various types of coating materials may be provided for the desired coating or liner. While the spray nozzles shown herein have been mounted on a pair of carriages moveable along the arcuate arms 62 and 64, it is understood that various types of nozzle assemblies may be utilized with suitable carriages for moving back and forth along arcuate arms. Under some conditions, it may be advisable to utilize more than two nozzle carriages. The thickness of the coating is determined primarily by the speed of the spray coating device 14 along pipeline 12, the speed of spray carriages 124 moving back and forth along arms 62, 64 and the amount of coating material discharged from nozzles 142. A single operator at the control panel 20 is able to control the entire coating process. The self-propelled support vehicle utilizes a boom which is employed during the entire coating operation as the boom supports various lines utilized in the operation of the spray coating device and is effective in maintaining a predetermined location of the various lines.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A spray coating device for spray coating an exterior surface of a pipeline and supported on said pipeline for longitudinal movement along the pipeline, said spray coating device comprising:

a pair of arcuate arms on opposed sides of said pipeline mounted for pivotal movement between an operative position encircling the pipeline and an inoperative position removed from the pipeline, each arm having radially spaced inner and outer guides;

a flexible endless drive member mounted on each arm and extending for about 180 degrees along the associated arm between said inner and outer guides thereon;

a spray nozzle carriage for each arm mounted for back and forth movement along said inner and outer guides between ends of said arm, each carriage having a spray nozzle thereon directed towards the pipeline for spraying a coating on the pipeline; and a connecting member between each carriage and the associated flexible endless drive member to connect the drive member in driving relation to said carriage, said connecting member effective at the ends of the arm to transfer the driving force for said carriage between inner and outer runs of said endless drive member to permit a continuous movement of said endless drive member for the entire travel cycle of said carriage.

2. The spray coating device as defined in claim 1, wherein said flexible endless drive member comprises a chain mounted on sprockets for continuous movement in one direction, and said connecting member is mounted between said chain and said carriage for transferring a driving force to said carriage.

3. The spray coating device as defined in claim 2, wherein said carriage has a plurality of rollers mounted on said inner and outer guides to support said carriage for movement.

4. The spray coating device as defined in claim 3, wherein said arms have upper ends pivotally mounted for swinging movement in a generally vertical plane between a closed operative position encircling said pipeline and an open inoperative position for positioning on and off said pipeline.

5. The spray coating device as defined in claim 1, further comprising:

an upper frame having rollers for contacting the upper surface of said pipeline for movement of said device along said pipeline, and;

a pair of arms pivotally mounted on said frame for movement between a position engaging the outer surface of the pipeline and a position disengaged from the outer surface of the pipeline, each arm having a roller for contacting the pipeline to effect centering of the device on the pipeline.

6. The spray coating device as defined in claim 1, further comprising:

a telescoping boom for lifting of said device on and off of said pipeline; and a plurality of hoses for coating material supported on said boom and extending to said device for the supply of coating material for said nozzles.

7. The spray coating device as defined in claim 1, wherein said arms on opposed sides of said pipeline are offset longitudinally from each other, and a connecting member extends between said arms adjacent the lower ends of said arms for connecting said arms together in encircling relation about the pipeline.

8. The spray coating device as defined in claim 1, comprising:

an upper main frame on said spray coating device having front and rear rollers contacting the upper surface of said pipeline for movement along the pipeline;

an arm supporting frame mounted on said main frame and extending rearwardly therefrom, said arm supporting frame having a pair of opposed end walls and a drive shaft supported on said walls for rotation; and intermediate drive connections between said drive shaft and said flexible endless drive members for driving said endless drive members.

9. The spray coating device as defined in claim 8, wherein said intermediate drive connections include a countershaft for each arm in axial alignment with each other and driven from said drive shaft, said arms being mounted for pivotal movement on the countershafts and said endless drive members being driven from said countershafts.

10. A spay coating device for spray coating an exterior surface of a pipeline and supported on said pipeline for longitudinal movement along the pipeline, said spray coating device comprising:

a pair of arcuate arms on opposed sides of said pipeline mounted for movement between a closed operative position encircling the pipeline and an open inoperative position removed from the pipeline;

a flexible endless drive member mounted on each arcuate arm and extending for about 180 degrees along the associated arm between opposed ends of the arm;

a spray nozzle carriage for each arm operatively connected to an associated endless drive member for movement along said arm between the ends of said arm, each carriage having a spray nozzle thereon directed toward the pipeline for spraying a coating on the pipeline;

a main support frame having front and rear rollers contacting the upper surface of said pipeline for movement along the pipeline;

an auxiliary support frame mounted on said main support frame and extending rearwardly therefrom, said auxiliary support frame including a hood having end walls;

a drive shaft supported from said end walls and having a pair of sprockets thereon; and an intermediate drive mechanism between said sprockets and said endless drive members for driving of said endless drive members and carriages thereon.

11. The spray coating device as defined in claim 10, wherein said intermediate drive mechanism comprise a countershaft for each arm having a pair of sprockets thereon;

a sprocket chain between one of said sprockets on said countershaft and one of said sprockets on said drive shaft; and another sprocket chain between the other of said sprockets on said countershaft and a sprocket for the associated endless drive member for driving of said endless drive member and carriage thereon.

12. A coating apparatus for spray coating an exterior surface of a pipeline, comprising:

a self-propelled spray coating device mounted on said pipeline for longitudinal movement along the pipeline, said spray coating device having a pair of arcuate arms on opposed sides of the pipeline and a spray nozzle carriage having a spray nozzle thereon mounted on each arm for arcuate back and forth movement along the associated arm;

a self-propelled support vehicle mounted alongside said pipeline and moving along said pipeline with said spray coating device, said support vehicle having spray coating components thereon for mixing and supplying the spray coating material to said nozzle for discharge onto the outer surface of the pipeline, and a control panel on said support vehicle for an operator to control the spray coating operation; and a telescoping boom pivotally mounted on said self-propelled support vehicle for lifting said spray coating device onto said pipeline, said boom supporting supply lines for said spray coating material extending between said spray nozzles from said support vehicle;

a support frame on said spray coating device having front and rear rollers supporting said device on the upper surface of said pipeline for movement along the pipeline; and a support stand on the ground surface adjacent said pipeline having an upper generally flat support table thereon and being of a length less than the spacing between said front and rear rollers of said spray coating device, said spray coating device when removed from the pipeline being supported on said stand with said frame of said device contacting and supported on said table between said front and rear rollers of said spray coating device.

13. The spray coating apparatus as set forth in claim 12, further comprising:

a flexible endless drive member including a sprocket chain for each arm, a sprocket adjacent each end of each arm having said sprocket chain mounted thereon; and a connecting member between said sprocket chain and said carriage for said arm for reciprocating said carriage back and forth along said arm upon movement of said sprocket chain.

14. The spray coating apparatus as set forth in claim 12, wherein said connecting member comprises a pin mounted on said sprocket chain for movement therewith, said pin contacting said carriage in drive relation.

15. The spray coating apparatus as defined in claim 14, wherein said carriage has a plate and rollers thereon mounting said carriage for movement along said arm, said plate having an elongate slot therein receiving said connecting pin for driving of said carriage, said pin at opposed ends of said endless drive member moving along said slot to reverse the movement of said carriage.

16. A spray coating device for spray coating an exterior surface of a pipeline:

said spray coating device comprising;

a main frame having rollers contacting the upper surface of said pipeline for movement of said device along said pipeline;

a pair of opposed centering rollers mounted on said main frame for movement between an engaged position with opposed sides of said pipeline and a disengaged position out of contact with said pipeline;

a support frame mounted on said main frame and extending rearwardly therefrom;

a pair of opposed arcuate arms supported from said support frame for pivotal movement between a closed operative position encircling the pipeline and an open inoperable position removed from the pipeline;

a nozzle carriage mounted on each arcuate arm;

an endless drive member connected to each nozzle carriage to drive said nozzle carriage back and forth along the associated arcuate arm;

a drive shaft mounted on said support frame; and an intermediate drive mechanism between said drive shaft and the endless drive members for driving said endless drive members and the nozzle carriages connected thereto.

17. The spray coating device as defined in claim 16, wherein said support frame has opposed end walls, and said drive shaft is supported for rotation on said opposed end walls.

18. The spray coating device as defined in claim 17, wherein said intermediate drive mechanism includes a pair of sprockets on said drive shaft, a countershaft for each endless drive member connected in driving relation thereto; and a drive connection between said pair of sprockets on said drive shaft and the countershafts for rotation of said countershafts in driving relation.

19. The spray coating device as defined in claim 17, wherein said support frame has a pair of support plates between said end walls, said arms being supported from said support plates.

20. The spray coating device for spray coating the exterior surface of a pipeline as defined in claim 17, wherein said drive shaft has a pair of sprockets thereon and said intermediate drive mechanism comprises a countershaft for each arm having a pair of opposed sprockets thereon;

a sprocket chain between one of said sprockets on said countershaft and one of said sprockets on said drive shaft; and another sprocket chain between the other of said sprockets on said countershaft and a sprocket connected to said endless drive member.

21. A coating apparatus for spray coating an exterior surface of a pipeline, comprising:

a self-propelled spray coating device mounted on said pipeline for longitudinal movement along the pipeline, said spray coating device having a pair of arcuate arms on opposed sides of the pipeline and a spray nozzle carriage having a spray nozzle thereon mounted on each arm for arcuate back and forth movement along the associated arm;

a self-propelled support vehicle mounted alongside said pipeline and moving along said pipeline with said spray coating device, said support vehicle having spray coating components thereon for mixing and supplying the spray coating material to said nozzle for discharge onto the outer surface of the pipeline, and a control panel on said support vehicle for an operator to control the spray coating operation;

a telescoping boom pivotally mounted on said self-propelled support vehicle for lifting said spray coating device onto said pipeline, said boom supporting supply lines for said spray coating material extending between said spray nozzles from said support vehicle;

a flexible endless drive member including a sprocket chain for each arm, a sprocket adjacent each end of each arm having said sprocket chain mounted thereon; and a connecting member between said sprocket chain and said carriage for said arm for reciprocating said carriage back and forth along said arm upon movement of said sprocket chain.

22. The spray coating apparatus as set forth in claim 21, wherein said connecting member comprises a pin mounted on said sprocket chain for movement therewith, said pin contacting said carriage in drive relation.

23. The spray coating apparatus as defined in claim 22, wherein said carriage has a plate and rollers thereon mounting said carriage for movement along said arm, said plate having an elongate slot therein receiving said connecting pin for driving of said carriage, said pin at opposed ends of said endless drive member moving along said slot to reverse the movement of said carriage.

* * * * *